United States Patent [19]

Fallos

[11] Patent Number: 5,056,297

[45] Date of Patent: Oct. 15, 1991

[54] ROTARY BRUSH FLAP CLOSER

[75] Inventor: George Fallos, Easton, Pa.

[73] Assignee: Bell & Howell Phillipsburg Co., Skokie, Ill.

[21] Appl. No.: 635,712

[22] Filed: Dec. 28, 1990

[51] Int. Cl.[5] ..... B65B 7/00; B65B 49/06

[52] U.S. Cl. ..... 53/482; 53/284.3; 53/377.6; 53/387.2; 53/460; 493/245

[58] Field of Search ..... 53/460, 482, 476, 284.3, 53/377.6, 378.3, 387.2, 387.1, 376.3; 493/245, 453

[56] References Cited

U.S. PATENT DOCUMENTS

| | | | |
|---|---|---|---|
| 2,641,318 | 6/1953 | Brody | 53/378.3 X |
| 3,015,926 | 1/1962 | Galambos | 53/378.3 |
| 3,395,624 | 8/1968 | Seyl | 493/245 |
| 3,962,848 | 6/1976 | Hankins | 53/284.3 |
| 4,173,921 | 11/1979 | Mack | 53/387.2 |
| 4,499,705 | 2/1985 | Russell | 53/284.3 |
| 4,932,188 | 6/1990 | Krasuski et al. | 53/284.3 X |

*Primary Examiner*—James F. Coan

*Attorney, Agent, or Firm*—Griffin, Branigan & Butler

[57] ABSTRACT

A rotary flap closer for closing envelope flaps during processing of mailable articles comprises a rotary member having a revolving arm and an elastically resilient member mounted along the arm and revolving therewith. At least a portion of the elastically-resilient member extends from the arm toward a conveyor surface on which envelopes are conveyed to and through the rotary flap closer, whereby the elastically-resilient member slidingly engages open flaps, deflects the flaps onto the envelope bodies, and thereby closes the envelopes. In one embodiment the elastically-resilient member is a brush.

21 Claims, 3 Drawing Sheets

ROTARY BRUSH FLAP CLOSER

BACKGROUND OF THE INVENTION

1. Field of the Invention

This invention relates generally to mechanisms for automatic preparation and processing of mailable articles, and more particularly to mailable article processing devices for closing of flaps of envelopes during high-speed automatic handling of envelopes.

2. Prior Art and Other Considerations

Insertion machines for preparation and processing of mailable articles by automatically inserting varous inserts into envelopes often include devices for closing of flaps and sealing of envelopes.

For instance, U.S. Pat. No. 4,932,188 to Krasuski et al. discloses apparatus for closing envelopes, wherein envelopes 5 travel along a path (in a first direction) with the flap trailing (gummed face down) through a moistening mechanism that is moved into contact with the gummed flap surface (FIG. 2B). Once the flap has exited from the moistening mechanism, the envelope is stopped and a fold-and-closing roller arrangement is moved into position onto the flap so that the flap is deflected downwardly (FIG. 2C). Thereafter, envelope 5 is moved in the reverse direction with the flap being folded onto the envelope and pressed thereon by and between presser rollers 30 and 31 (FIG. 2D). Subsequently, in one embodiment, the envelope motion is again reversed (into the first direction) and the closed envelope 5 is transported to a reception compartment (FIG. 2E).

Another example of a device for closing of envelope flaps is shown in U.S. Pat. No. 3,962,848 issued to Hankins. Hankins discloses an envelope-flap processing apparatus including means for automatically closing flaps. Envelopes travel past a stationary rigid deflector device that deflects and guides a flap into closed position as envelopes are conveyed past the device in the direction of the flap-fold edge.

U.S. Pat. No. 4,499,705 to Russel also discloses an insertion machine including such a mechanism. As particularly shown in FIG. 11, an envelope is moved into the shown position (flap closing station) having its flap 12 closed by abutment finger 154 as the envelope travels (in direction of the flap-fold edge) to this position. Rubber roller 156 is then moved from the side of the envelope over the flap 12 completely to close the flap.

Other envelope-flap closing devices have also been employed. For example, flap closers of a not uncommon kind rely upon the action of rollers onto an envelope (and its flap) that is being conveyed therebetween subsequent to the flap having been guided to an acute angle in relation to its envelope.

As requirements on quality, speed, and economy of processing of mailable articles increase, for example with respect to reliability, throughput rate, and relatively low equipment cost, corresponding demands are also made on flap closing devices. The market demands low equipment-complexity and, at the same time, equipment capability in handling ranges of envelope types, sizes, and thicknesses without a need for adjustment and resetting of mechanisms.

It is desirable that individual machine runs include intermixed thicknesses of envelopes in a broad thickness range, for instance, wherein some envelopes hold one or two inserts (for example checks) and other envelopes hold several tens of inserts. Such greater thicknesses can amount to as much as a large fraction of an inch. Consequently, it is becoming more and more important that flap closing devices also be capable of processing intermixed envelopes in wide ranges of thicknesses without a need for adjustment or resetting.

In general, conventional flap closing devices have not been capable of fulfilling particularly these latter demands while being able to process envelopes at high throughput rates with a high degree of reliability and while being of relatively low complexity and cost.

The rotary flap closer of the present invention is capable of high-speed and reliable processing of envelopes during runs containing intermixed envelopes in a great variety of thicknesses. At the same time, the rotary flap closer of the invention is of relatively low cost and exhibits distinct mechanical simplicity.

Accordingly, an important overall feature of the invention is the provision of an improved envelope-flap closer mechanism and an improved method for closing flaps of envelopes, whereby the mechanism is of low complexity and is capable of reliable, high-throughput rates for batches including relatively broad ranges of intermixed envelope thicknesses without a need for adjustment of the mechanism.

SUMMARY OF THE INVENTION

In accordance with principles of the present invention, there is provided an improved flap closer mechanism and an improved method for closing flaps of envelopes. The envelopes are conveyed to and through the mechanism on the surface of a conveyor device in flap-up orientation, wherein the mechanism comprises a rotary member having a revolving arm and an elastically-resilient member mounted along the arm. At least a portion of the elastically-resilient member extends from the revolving arm toward the conveyor surface. The elastically-resilient member revolves and engages open flaps, deflects the flaps onto the envelope bodies, and thereby closes envelopes. The rotary member is disposed in cantilevered manner and mounted laterally with respect to envelopes being conveyed through the mechanism. In one embodiment of the rotary flap closer, the elastically-resilient member is a brush.

In operation, envelopes with open flaps are conveyed on and along the conveyor surface partially beneath the cantilevered portion of the rotary member (while the rotary member revolves) and between the elastically-resilient member and the conveyor surface. Envelopes are conveyed in the direction of their flap-fold and with the flap-fold on the side of the mounting of the rotary member. The elastically-resilient member sweeps over the envelope, engages the envelope's open flap, deflects and presses the flap onto the body of the envelope, and thereby closes the flap. The elastically-resilient properties of the elastically-resilient member provide pressure onto the closed flap to promote adhesion of its gummed surface onto the body of the envelope. Moreover, these elastically-resilient properties permit processing of envelopes with different thicknesses without need for adjustment of the rotary flap closer mechanism to accommodate different thicknesses.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
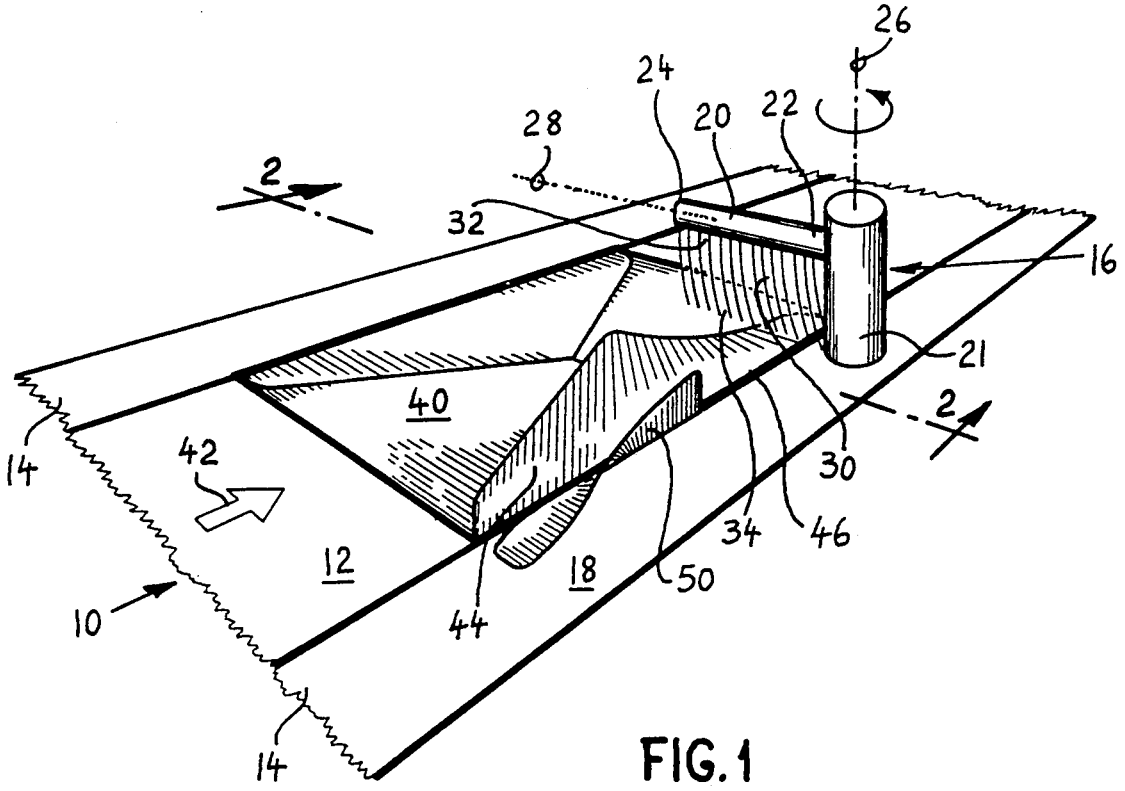
FIG. 1 is an overall schematic, perspective illustration of a rotary flap closer according to principles of the present invention.
Figure 2:
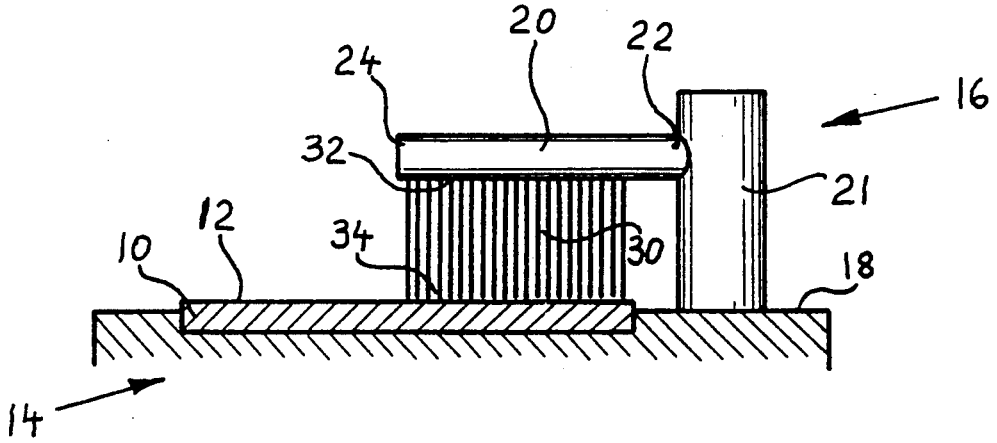
FIG. 2 is a schematic, elevational, rear view of the rotary flap closer shown in FIG. 1 including a vertical section along section lines 2—2 (FIG. 1) through a conveyor surface portion; and, FIG. 3 is a schematic, elevational, rear view of another embodiment of the invention.

Referring now to FIGS. 1 and 2, the flap closer comprises envelope-conveying means 10 having a conveying face 12, carrying means 14 for carrying and supporting conveying means 10, and a rotary member 16. Carrying means 14 includes a support side 18 on which rotary member 16 is supported in a cantilevered manner. Support side 18 is disposed on a first lateral side from conveying face 12. Rotary member 16 includes an arm 20 and a support 21. Arm 20 includes an unsupported end 24 and a supported end 22 that is supported in support 21.

Rotary member 16 further comprises an elastically-resilient member 30 having a proximal end region 32 and a distal-end region 34. Proximal end region 32 is secured to arm 20 and extends therealong. Elastically-resilient member 30 is revolvable with arm 20.

Rotary member 16 also includes means for rotating elastically-resilient member 30. In a first embodiment of the invention, as illustrated in FIGS. 1 and 2, support 21 is formed as a rotatable shaft (or at least includes a rotatable shaft) for drivable rotation. Shaft 21 rotates about axis of rotation 26, and rotates elastically-resilient member 30. Axis of rotation 26 is defined in that it is disposed substantially coaxially with support or shaft 21 in a fixed orientation and spacing in relation to carrying means 14.

The means for rotatably driving shaft 21 is a motor, not shown.

Elastically-resilient member 30 is preferably an elongated thin brush having a plurality of bristles oriented substantially radially from arm 20 at one circumferential location thereof (pointing substantially toward conveying face 12) and having an overall length to substantially reach conveying face 12 with distal end region 34. One or more rows of bristles can be provided. The bristles can be generally slightly tilted from a radial orientation up to about ten degrees or more so that they trail in respect to the direction of rotation, as indicated.

Elastically-resilient member 30 can comprise a brush having bristles or, alternately it can comprise, for example, comb-like flexible teeth instead. Also, member 30 can alternately comprise a plurality of flexible fingers having rollers disposed at distal end region 34. In any case, properties of member 30 include elasticity and resilience to facilitate elastic flexing while providing pressure onto flaps of envelopes during flap closing. Bristles of brushes for elastically-resilient member 30 can be made from natural or artificial fibers, from elastomeric materials or from metals. Similarly, comb-like teeth can be made of metals, plastics, elastomers, or the like.

Envelope 40 is shown being conveyed by envelope conveying means 10 upon and along conveying face 12 in the direction of arrow 42. Envelope 40 is shown as its flap 44 is being closed by the rotary flap closer mechanism. Flap 44 is joined to the envelope body by a flap-fold edge 46 about which the flap is folded or hinged.

A deflecting and guiding means 50 in the form of a twisted-surface structure is mounted on support side 18 and is arranged to engage envelope-flaps conveyed therealong and to deflect and guide these flaps to at least a generally upwardly perpendicular orientation (or more) with respect to the plane of the conveying face 12. Deflecting and guiding means 50 is provided to achieve this latter flap orientation prior to engagement of the flap by elastically-resilient member 30 for envelope flaps which may not be thusly oriented already. Envelopes arriving with flaps oriented at an acute angle with respect to the envelope body do not require deflecting or guiding.

Indicated by a phantom line in FIG. 1 is also an axis 28 about which elastically-resilient member 30 is revolvable in a second embodiment of the invention. Axis 28 is disposed substantially coaxially with arm 20 in a fixed orientation and spacing in relation to carrying means 14. Accordingly, arm 20 represents in this second embodiment the means for drivably rotating elastically-resilient member 30. In this second embodiment therefore, arm 20 is revolvable (and therewith elastically-resilient member 30) about axis 28 while support 21 is irrotationally fixed in the orientation shown. Hence, during rotation of arm 20, distal end region 34 of member 30 repeatedly reaches the surface of envelope 40 and flap 44 and deflects the flap onto the envelope's surface. Although the motion of member 30 of this second embodiment is different from the motion of member 30 in the first embodiment, flap closing is performed similarly, at least in regard to the end effect. A slightly-different structural version of this second embodiment will be discussed in conjunction with FIG. 3.

In operation, envelopes are conveyed in seriatim upon conveying face 12 in flap-up orientation and in the direction of the flap-fold edge 46 (in direction of arrow 42) with the flap-fold edge facing toward support side 18. Elastically-resilient member 30 is rotated and slidingly contacts and sweeps over areas of envelopes that correspond to flap surfaces of closed-flap envelopes while the envelopes are conveyed and disposed between conveying face 12 and distal end region 34. Elastically-resilient member 30 thusly flexes, deflects, and presses open flaps of envelopes onto envelope bodies and thereby closes the flaps.

In one mode of operation, envelopes are continuously conveyed and elastically-resilient member 30 revolves continuously. In another mode of operation, envelopes are conveyed intermittently while member 30 revolves continuously. In the latter mode, envelopes are stopped temporarily while disposed so that flap deflection is at least partially effected by elastically-resilient member 30. In yet another mode of operation, member 30 revolves intermittently, being stopped during the interval between successive envelopes as envelopes are temporarily beyond reach of member 30.

It will be appreciated that employment of elastically-resilient member 30 (having elastically-resilient properties) in conjunction with its rotation permits and facilitates closing of flaps of intermixed envelopes of a variety of thicknesses. Member 30 will flex more when sweeping over envelopes of greater thickness and less over envelopes of lesser thickness, yet the member's effectiveness in closing flaps will not appreciably change.

Figure 3:
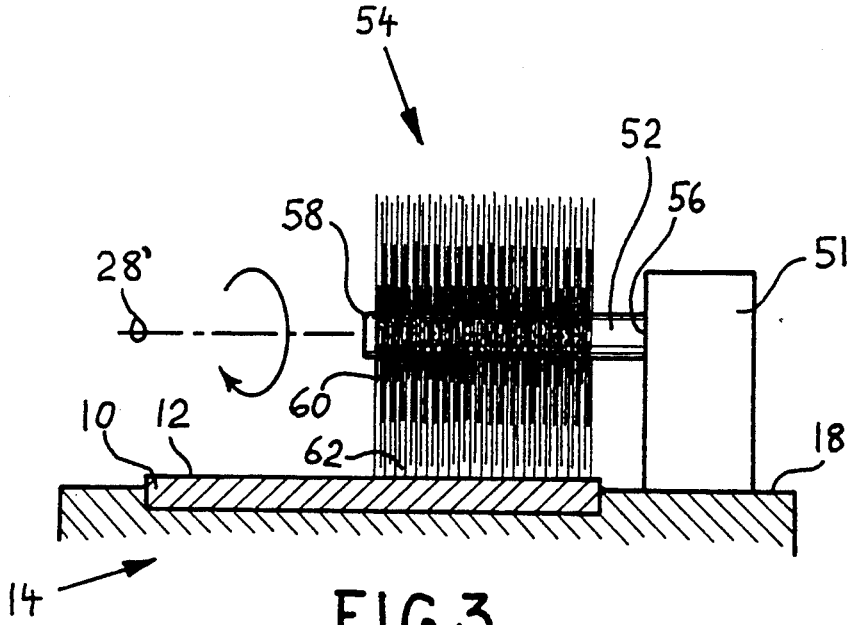

The structure of FIG. 3 is similar to that of FIG. 2, except that support 21 of FIGS. 1 and 2 is now (in FIG. 3) a support 51 that is non-rotatable, arm 20 of FIGS. 1 and 2 is now (in FIG. 3) an arm 52 that is rotatable substantially about axis 28', and elastically-resilient member 30 of FIGS. 1 and 2 is now (in FIG. 3) an elastically-resilient member 54 that comprises a cylindrical brush having bristles substantially radially oriented with respect to arm 52—the bristles being distributed substantially equally about the periphery of arm 52. In this embodiment, arm 52 is the means for drivably rotating elastically-resilient member 54.

Arm 52 has a supported end 56 and an unsupported end 58. Elastically-resilient member 54 has a proximal end region 60 (at which it is mounted on arm 52) and a distal end region 62 at the distal ends of the bristles.

In other respects, operation of the embodiment shown in FIG. 3 parallels the operation described in conjunction with FIGS. 1 and 2. Envelopes are conveyed in seriatim upon conveying face 12 in flap-up orientation and in the direction of the flap-fold edge 46 (in the direction of arrow 42) with the flap-fold edge facing toward support side 18. Elastically-resilient member 54 is rotated and slidingly contacts and sweeps over areas of envelopes that correspond to flap surfaces of closed-flap envelopes while envelopes are conveyed and disposed between conveying face 12 and distal end region 62. Elastically-resilient member 54 thusly flexes, deflects, and presses open flaps of envelopes onto envelope bodies and thereby closes the flaps.

In one mode of operation, envelopes are continuously conveyed and elastically-resilient member 54 revolves continuously. In another mode of operation, envelopes are conveyed intermittently while member 54 revolves continuously. In the latter mode, envelopes are stopped temporarily while disposed so that flap deflection is at least partially effected by elastically-resilient member 54. In yet another mode of operation, member 54 revolves intermittently—being stopped during the interval between successive envelopes as envelopes are temporarily beyond reach of member 54.

It will be appreciated that employment of elastically-resilient member 54 (having elastically-resilient properties) in conjunction with its rotation permits and facilitates the closing of flaps of intermixed envelopes of a variety of thicknesses. Member 54 will flex more when sweeping over envelopes of greater thickness and less over envelopes of lesser thickness, yet the member's effectiveness in closing flaps will not appreciably change.

It should be understood that, although arrows are shown about axes 26 (FIG. 1) and 28' (FIG. 3), either direction of rotation about these axes is practical without appreciably significant difference in performance for any of the described embodiments. Also it should be understood that, whereas the embodiments described in the foregoing have employed either rotation about axis 26 or about axis 28 (or 28') as preferred modes of operation, simultaneous rotation about both axes can be employed, albeit at the expense of increased complexity and cost.

While the invention has been particularly shown and described with reference to preferred embodiments thereof, it will be understood by those skilled in the art that various changes and modifications in form and details may be made therein without departing from the spirit and scope of the invention. The invention could also be practiced, for example, if dual rotating arms 54 were employed.

Similarly, the above description has been in connection with a flap closer wherein the arm 30 is adapted to be rotated once per envelope or machine cycle of the mail processor. The rotary member 16, however, can be mechanically disconnected from its operation with the overall system and operated separately. That is, member 16 can be operated by a separate, suitably-timed motor (not shown); or, alternatively, it can be operated by a rack and pinion (not shown) at the end of support 21. In this latter manner the rack is moved in a first direction to pivot the arm 20 over the flap to seal the flap. The rack is then moved in the opposite direction to pivot the arm 20 back to its original position. By thusly disconnecting the flap-closer from the overall conveying system the envelope flap closure can be completed even if the conveyor is stopped when an elastically-resilient member such as 30 would otherwise have only swept a portion, but not all, of the envelope flap's length.

The embodiments of the invention in which an exclusive property or privilege is claimed are defined as follows:

1. A rotary flap closer for closing flaps of envelopes during processing of mailable articles, the envelopes having a flap-fold edge, said rotary flap closer comprising:

conveying means for conveying envelopes, said means for conveying having a conveying face upon and along which envelopes are conveyed;

carrying means for carrying said means for conveying, said means for carrying including a support side disposed laterally with respect to said conveying face; and a rotary member supported and mounted on said support side, said rotary member including an arm having a supported end and an unsupported end, said arm extending to said unsupported end from said supported end from a location above said support side, said rotary member including an elastically-resilient member having a proximal-end region and a distal-end region, said proximal-end region being secured to said arm and extending therealong, said rotary member including means for rotating said elastically-resilient member, said means for drivably rotating defining an axis of rotation substantially coaxially therewith about which said elastically-resilient member is rotatable, said axis of rotation being fixedly oriented and spaced with respect to said carrying means;

wherein envelopes are conveyed in seriatim upon said conveying face in flap-up orientation and in the direction of said flap-fold edge so that the flap-fold edge faces toward said support side, and wherein at least a portion of said elastically-resilient member extends from said arm toward said conveying face so that at least a portion of said distal-end region resiliently and slidingly contacts and sweeps over the flaps of said envelopes while said envelopes are disposed between said conveying face and said distal-end region and while said elastically-resilient member is revolved, said elastically-resilient member being operative in closing flaps of envelopes as said distal-end region resiliently and slidingly contacts and sweeps over said envelopes.

2. The rotary flap closer according to claim 1, including a rotatable support on said support side above said carrying means, said axis of rotation being disposed substantially coaxially with said rotatable support.

3. The rotary flap closer according to claim 1, wherein said axis of rotation is disposed substantially coaxially with said arm.

4. The rotary flap closer according to claim 1, wherein said elastically-resilient member includes a brush having bristles oriented substantially radially with respect to said arm, said bristles being distributed substantially equally about the periphery of said arm.

5. The rotary flap closer according to claim 1, wherein said elastically-resilient member includes a brush.

6. The rotary flap closer of claim 5, wherein the bristles of said brush are bristles made from metal.

7. The rotary flap closer of claim 5, wherein the bristles of said brush are bristles made from natural fibers.

8. The rotary flap closer of claim 5, wherein the bristles of said brush are bristles made from artificial fibers.

9. The rotary flap closer of claim 5, wherein the bristles of said brush are bristles made from elastomeric material.

10. The rotary flap closer according to claim 1, wherein said elastically-resilient member includes comb-like teeth.

11. The rotary flap closer of claim 10, wherein said comb-like teeth are made from metal.

12. The rotary flap closer of claim 10, wherein said comb-like teeth are made from a plastic material.

13. The rotary flap closer of claim 10, wherein said comb-like teeth are made from elastomeric material.

14. The rotary flap closer according to claim 1, wherein said carrying means includes deflecting means for deflecting and guiding open flaps of envelopes to at least a substantially perpendicular orientation with respect to said conveying face while said envelopes are being conveyed therealong to the vicinity of said elastically-resilient member, said deflector means being disposed on said support side.

15. A method for closing flaps of envelopes in a rotary flap closer during processing of mailable articles, said method comprising the steps of:

(a) conveying envelopes in seriatim upon and along a conveying face in flap-up orientation and in the direction of a flap-fold edge so that said flap-fold edge faces toward a first lateral side of said conveying face;

(b) revolving about an axis an elastically-resilient member that is secured to and extends along a cantilevered arm at a proximal-end region of said elastically-resilient member, said elastically-resilient member having a distal-end region, at least a portion of said distal-end region being capable of reaching envelopes that are conveyed past said distal-end region while said elastically-resilient member revolves, said axis being fixedly oriented and spaced with respect to said conveying face; said cantilevered arm being supported on said first lateral side;

(c) slidingly contacting and sweeping said elastically-resilient member over the flap areas of said envelopes while said envelopes are conveyed and disposed between said conveying face and said distal-end region and while said elastically-resilient member revolves;

(d) deflecting and pressing said flaps of said envelopes onto the envelope bodies and thereby closing said envelope flaps as said distal-end region resiliently and slidingly contacts and sweeps over said envelopes that are being conveyed along said conveying surface beneath said elastically-resilient member while said elastically-resilient member revolves; and, (e) flexing said elastically-resilient member while step (d) is being effected so that said flaps of said envelopes having different thicknesses are closed without need for adjustment of the rotary flap closer.

16. The method according to claim 15, wherein the axis of step (b) is oriented substantially orthogonally to a plane through said conveying face and is disposed on said first lateral side.

17. The method according to claim 15., wherein the axis of step (b) is oriented substantially parallel to said conveying face and is spaced therefrom.

18. The method according to claim 15, wherein step (a) includes temporarily stopping the conveying of said envelopes while step (d) is being at least partially effected.

19. The method according to claim 15, including temporarily stopping said revolving step during an interval between successive envelopes as envelopes.

20. The method according to claim 15, wherein said elastically-resilient member includes a brush, and whereby said step (c) includes brushing over said flap areas of said envelopes.

21. The method according to claim 15, wherein step (a) includes guiding and deflecting open flaps of envelopes to at least a substantially perpendicular orientation with respect to said conveying face while said envelopes are being conveyed therealong to the vicinity of said elastically-resilient member.

* * * * *